US005996804A

United States Patent [19]

Kuhn et al.

[11] Patent Number: 5,996,804

[45] Date of Patent: Dec. 7, 1999

[54] CONTAINER AND METHOD FOR PACKAGING CONTOURED ARTICLES

[76] Inventors: Wayne Kuhn, 12402 Ridge Ave., Palos Park, Ill. 60464; Shane Bertsch, 848 W. Webster Ave., Chicago, Ill. 60614

[21] Appl. No.: 09/057,765

[22] Filed: Apr. 9, 1998

[51] Int. Cl.[6] ..... B65D 81/02

[52] U.S. Cl. ..... 206/593; 206/193; 206/429

[58] Field of Search ..... 206/193, 427, 206/477, 483, 485, 593; 229/120.12, 120.08

[56] References Cited

U.S. PATENT DOCUMENTS

| | | | |
|---|---|---|---|
| 1,684,579 | 9/1928 | Ferguson et al. . | |
| 2,620,962 | 12/1952 | Powell . | |
| 2,760,677 | 8/1956 | Arneson | 220/115 |
| 3,119,544 | 1/1964 | Cope et al. | 229/14 |
| 3,160,326 | 12/1964 | Sturdevant et al. | 222/183 |
| 3,349,986 | 10/1967 | Chapman et al. | 229/14 |
| 3,499,582 | 3/1970 | Berney | 222/183 |
| 4,088,262 | 5/1978 | Kuehlhorn | 229/27 |
| 4,133,428 | 1/1979 | Glöyer | 206/427 |
| 4,174,051 | 11/1979 | Edwards et al. | 222/105 |
| 4,200,188 | 4/1980 | Webinger . | |
| 4,314,639 | 2/1982 | Glöyer | 206/427 |
| 4,397,416 | 8/1983 | Bishop | 229/52 |
| 4,832,199 | 5/1989 | Rigby | 206/485 |
| 4,927,042 | 5/1990 | Ring | 220/23.83 |
| 5,065,937 | 11/1991 | Ritter | 229/117.13 |
| 5,320,277 | 6/1994 | Stout et al. | 229/117.13 |
| 5,385,234 | 1/1995 | Stout et al. | 206/427 |
| 5,462,169 | 10/1995 | Dygert et al. | 206/521 |
| 5,505,309 | 4/1996 | Taravella et al. | 206/485 |
| 5,529,187 | 6/1996 | DeNola | 206/485 |
| 5,826,727 | 10/1998 | Fraser | 206/485 |

*Primary Examiner*—David T. Fidel
*Attorney, Agent, or Firm*—Dick and Harris

[57] ABSTRACT

The present invention is directed to a container apparatus and method for packaging contoured articles, particularly contoured articles containing hazardous substances. The container apparatus comprises a base member, upstanding sidewall members foldably emanating from the edges of the base member, and an article retaining member foldably emanating from the top edge of at least one of the sidewall members. The article retaining member is positionable toward and into the inner region of the container so as to form an acute angle with the sidewall from which it emanates. The article retaining member further includes an article retention edge to engage, stabilize, and prevent undesired movement of the contoured article(s) housed within the interior region of the container apparatus. In particular, the article retaining member prevents migration of the contoured articles in a vertical plane, in a horizontal plane, and in a rotational direction. Preferably, the container apparatus is constructed from a substantially unitary paperboard blank, and may include a dividing member for compartmentalizing the inner region of the container apparatus.

39 Claims, 4 Drawing Sheets

CONTAINER AND METHOD FOR PACKAGING CONTOURED ARTICLES

BACKGROUND OF THE INVENTION

1. Field of the Invention

The present invention relates in general to a container for packaging articles and, more particularly, to a container for releasably retaining contoured articles containing hazardous substances.

2. Background Art

Containers for packaging articles have been known in the art for many years. In particular, containers have long been used in the storage and transportation of hazardous materials. Typically, these containers comprise a base, four sidewalls attached to the base, and a lid. In addition, because hazardous articles require some degree of stabilization to comply with certain hazardous materials shipping regulations, these prior art containers have utilized different ways to stabilize the hazardous material containing articles. For instance, some of these prior art devices have relied upon the tight fit of the articles inside of the container for a secure fit. Others, in contrast, have used a divider to apportion the interior of the container into different sections. Still others have used cross sectional inserts into which holes are cut to match the size of the hazardous material containing articles.

Although these and other prior art containers have worked well, they have failed to protect hazardous material containing articles from impact imparted upon the top of the article when the container is jarred, impacted, or flipped during transportation and movement. Thus, it is a goal in the art to provide a container which stabilizes hazardous material containing articles in compliance with the United Nations Hazardous Materials Standards. Specifically, it is desirous to provide a container which prevents hazardous material containing articles from moving in the horizontal, vertical, and rotational planes, thus preventing both impact imparted to the top, bottom and sides of the articles from outside, as well as to prevent impact imparted from one article to another.

Furthermore, it is a goal in the art to provide a container apparatus of the kind specified which allows for great ease in loading and unloading hazardous material containing articles into and out of the container—for greater safety and speed in handling and transporting the articles.

Moreover, it is generally a goal in the art to provide a container apparatus of the kind specified above which is relatively simple and inexpensive to manufacture, as well as simple to assemble.

Finally, it is always a goal in the art to provide a container apparatus constructed from a substantially unitary blank of material so as to minimize the material waste associated with manufacturing such containers from blank configurations.

SUMMARY OF THE INVENTION

The present invention comprises a container apparatus for packing contoured articles, particularly contoured articles containing hazardous materials. The container apparatus comprises a base member having at least four edges, and upstanding sidewall members foldably emanating from each of the base member edges and an article retaining member foldably emanating from the top edge of at least one sidewall member.

The base member and upstanding sidewall members collectively define an interior region of the container apparatus for housing at least one contoured article, while the article retaining member is positionable toward and into the inner region of the container so as to form an acute angle with the sidewall from which it emanates. Furthermore, the article retaining member includes an article retention edge to engage, stabilize, and prevent undesired movement of the contoured article(s) housed within the interior region of the container apparatus. In a preferred embodiment, the retention edge is shaped so as to approximate the contoured region of a contoured article placed inside of the container apparatus—the retention edge consisting of, for instance, at least one slot configured to engage the contoured region of an article placed therein. Moreover, the container apparatus preferably includes two article retaining members. In operation, the article retaining members are preferably folded such that they are positioned inside of the inner region of the container apparatus. In this position, the article retaining members form an acute angle with the sidewall members from which they emanate. To this end, the article retaining members possess score lines to facilitate folding over the top edges of the corresponding sidewalls.

Contoured articles are then lowered into the container apparatus. Upon contact with an article retaining member, the contoured article forces the article retaining member downward into the inner region of the container and toward the corresponding sidewall. At this point, fold-line memory capabilities inherent in the article retaining member—either alone or in combination with manual manipulation—prompt the article retaining member to move away from the sidewall and back toward its original position. However, upon return to its original position, the retention edge of the article retaining member locates the contoured region of the contoured article. This location, in turn, prevents migration of the contoured articles in a vertical plane, in a horizontal plane, and in a rotational direction.

In a preferred embodiment, the container apparatus further includes a lid member for operably covering at least a portion of the inner region of the container apparatus after insertion of the contoured articles. Preferably, inasmuch as hazardous materials may be contained within the contoured articles, there is an air gap between the lid and the tops of the contoured articles housing within the container apparatus to prevent contact of the contoured articles by a force applied to the lid member.

In another preferred embodiment, the container apparatus is constructed from a substantially unitary blank including front, back, first, and second side panel members; a tab foldably emanating from the side edge of one of the side panel members; a bottom flap foldably emanating from the bottom edge of each side panel member; an article retaining flap, having a retention edge, foldably emanating from the top edge of opposing side panel members; and a top flap foldably emanating from the top edge of the other two opposing side panel members.

To articulate the container apparatus, the side panel members are folded such that two pairs of substantially parallel and opposing sidewalls are formed. The tab helps secure this arrangement. Next, the base member is formed by folding the bottom flaps toward the inside face of the sidewalls to form an interior region. Inasmuch as the opposing bottom flap members lie in the same approximate plane, the base member comprises at least two layers of overlapping paperboard material. Preferably, when corrugated paperboard is used, the directions of corrugation in the two overlapping layers of paperboard material run transversely, thus providing increased multidirectional strength to the container apparatus. After the base member is formed, the article retaining flaps are folded inside the container apparatus toward the sidewall members from which they emanate—preferably forming an acute angle with the corresponding sidewall members. Upon insertion of and stabilization of the contoured articles, the top flaps are folded down and sealed into position by an adhesive.

In yet another preferred embodiment, the container apparatus further includes a dividing member, preferably constructed from a substantially unitary paperboard blank. The dividing member comprises top and bottom center panels, top and bottom left wing panels, top and bottom right wing panels, top and bottom left end panels, and top and bottom right end panels. Upon articulation, the dividing member preferably comprises two substantially c-shaped rectangles.

Upon insertion of the dividing member into the inner region of the container apparatus, the top center panel is positioned in substantial abutment with the inside face of one sidewall, while the bottom center panel is positioned in substantial abutment with the inside face of an opposing sidewall. Meanwhile, the top and bottom left wing panels are positioned in substantial abutment with another container sidewall, while the top and bottom right wing panels are positioned in substantial abutment with an opposing sidewall. The top and bottom left, and top and bottom right, end panel folded combinations extend between a pair of opposing sidewalls, preferably bisecting the inner region of the container apparatus into two substantially rectangular compartments.

DETAILED DESCRIPTION OF THE INVENTION

Figure 1:
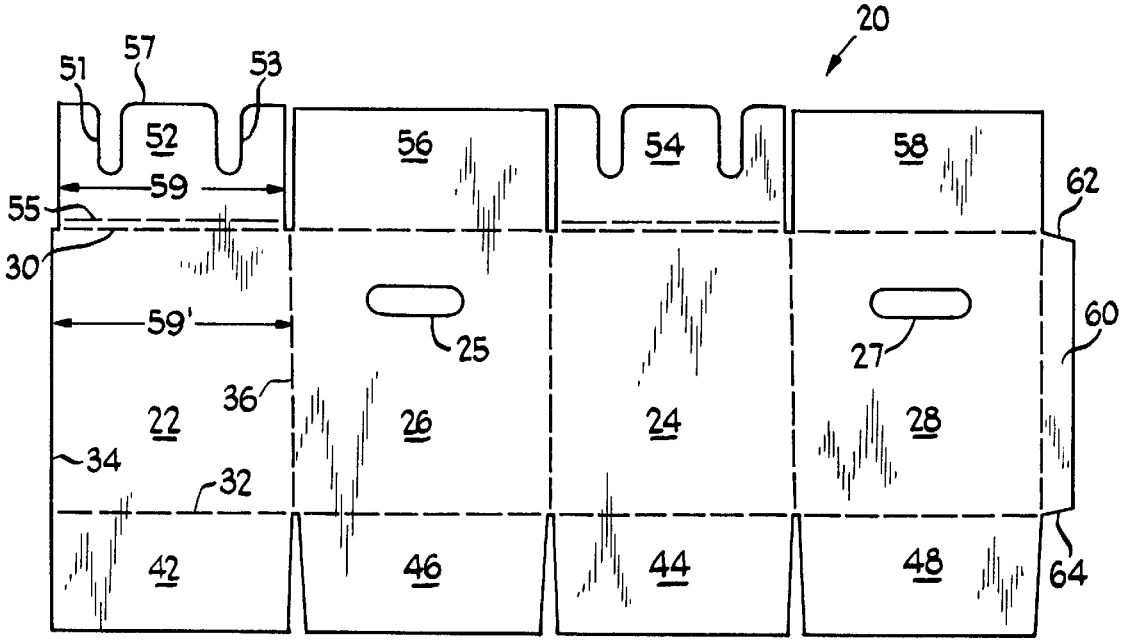
FIG. 1 of the drawings is a plan view of the blank for forming the container apparatus according to the present invention.

While this invention is susceptible of embodiment in many different forms, there is shown in the drawings and will herein be described in detail, several specific embodiments with the understanding that the present disclosure is to be considered as an exemplification of the principles of the invention and is not intended to limit the invention to the embodiments illustrated.

Container apparatus 100 for packaging contoured articles is shown in FIG. 1 in its pre-erected form as substantially unitary paperboard blank 20. Although substantially unitary paperboard blank is preferably constructed from two layers of corrugated paperboard, the blank may be constructed from one or more layers of paperboard material, or from either a single layer or multiple layers of a corrugated material. Construction from a substantially paper-based material, among other benefits, allows the container apparatus to be recycled after use. Moreover, substantially unitary paperboard blank 20 may be coated with a substantially moisture impervious material so as to provide added protection against water or other elements. However, although container apparatus 100 is preferably constructed from a substantially paper material, it is also contemplated that the container apparatus may be constructed of other substantially rigid materials including plastic, metal, wood, ceramic, or combinations thereof—including combinations with paperboard.

Substantially unitary paperboard blank 20 comprises front 22, back 24, first 26 and second 28 side panel members, each of which consist of four edges, including top edge 30, bottom edge 32, left side edge 34, and right side edge 36 (edges illustrated with respect to front side panel member 22). Front side panel member 22 foldably emanates from the left edge of first side panel member 26, which, in turn, foldably emanates from the left edge of back side panel member 24. Likewise, back side panel member 24 foldably emanates from the left edge of second side panel member 28.

Moreover, first and second side panel members 26 and 28 further include carrying means 25 and 27 to facilitate lifting, carrying and moving container apparatus 100 upon erection. As shown in FIG. 1, carrying means may consist of holes, handles, or perforated regions capable of being removed upon erection of the container apparatus. Of course, front and back side panel members 22 and 24 may also include a similar carrying means, either in addition to or in lieu of carrying means 25 and 27.

Substantially unitary paperboard blank 20 further consists of bottom flaps 42, 44, 46 and 48; top flaps 56 and 58; article retaining flaps 52 and 54; and tab 60. As can be seen from FIG. 1, bottom flaps 42, 44, 46, and 48 each foldably emanate from the bottom edges of corresponding side panel members 22, 24, 26, and 28. Moreover, although four bottom flap members are preferred, it is also contemplated that substantially unitary paperboard blank 20 may consist of as few as one or two bottom flaps. In particular, if blank 20 is constructed with only two bottom flaps, it is further contemplated that those bottom flaps foldably emanate from either front 22 and back 24 side panel members, or first 26 and second 28 side panel members. Furthermore, as it will also be understood by one of ordinary skill in the art, the bottom flap members may vary in size depending on the application, thus increasing the supportable strength, impact resistance, and/or drop resistance of erected container apparatus 100 (for instance, overlapping flap members may increase the thickness of the articulated base). Of course, conservation of material in the formation of paperboard blanks is always a consideration.

Top flaps 56 and 58 foldably emanate from the top edges of corresponding first and second side panel members 26 and 28. Of course, it is also contemplated that the top flaps may just as easily foldably emanate from the top edges of front and back side panel members 22 and 24, depending on the attachment of article retaining flaps 52 and 54 as described hereinbelow. Moreover, like the contemplated variations on the number of bottom flap members detailed above, it is likewise contemplated that substantially unitary paperboard blank 20 may consist of only one top flap member. Of course, with such a one top-flap design, as with the preferred two top-flap configuration, the size of the top flap(s) may vary according to specification. Again, such a variation of top flap size may serve different goals including, but not limited to, increasing the structural strength, impact resistance, and drop resistance of container apparatus 100 in its fully erected form.

Article retaining flaps 52 and 54 foldably emanate from the top edges of corresponding front and back side panel members 22 and 24. Of course, it is likewise contemplated that article retaining flaps 52 and 54 may also emanate from first and second side panel members 26 and 28, depending on container design specification. Furthermore, it is contemplated that substantially unitary paperboard blank 20 may consist of only one article retaining flap, depending on variables such as article size and container application.

Figure 2:
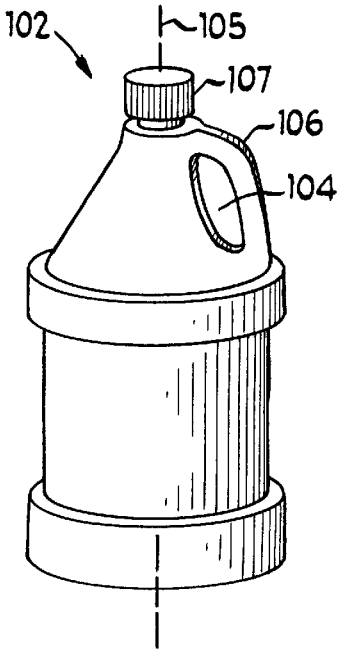
FIG. 2 of the drawings is a perspective view of a contoured article for use in association with the present invention, and specifically a handled bottle for use in association with the present invention.
Figure 3:
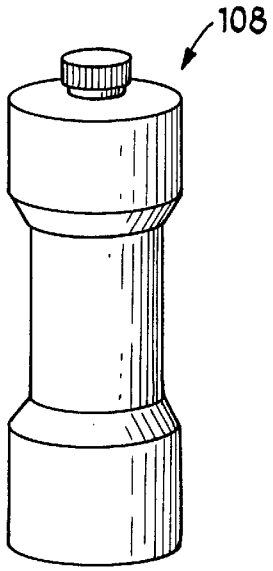
FIG. 3 of the drawings is a perspective view of another contoured article for use in association with the present invention.
Figure 4:
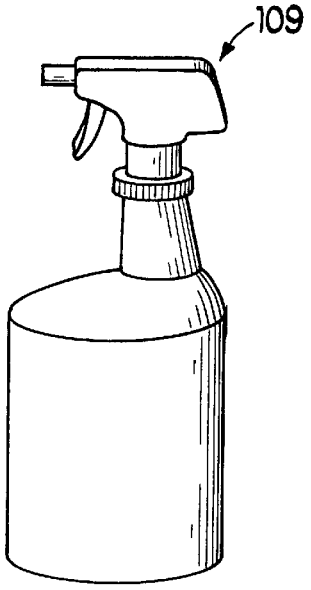
FIG. 4 of the drawings is a perspective view of yet another contoured article for use in association with the present invention.

Article retaining flap 52 consists of slots 51 and 53, retention edge 57, and score line 55. (Inasmuch as article retaining flaps 52 and 54 are substantially similar, reference will be made to article retaining flap 52 with the understanding that the same features and description apply to article retaining flap 54.) Slots 51 and 53 are shown in FIG. 1 as specifically configured for use in association with container articles 102, namely, one-gallon jugs having the handle configuration shown in FIG. 2. However, it is certainly contemplated that slots may be of any configuration for use in association with differing contoured articles, examples of which include contoured articles 108 and 109, shown in FIGS. 3 and 4. Moreover, although article retaining flaps 52 and 54 are shown in FIG. 1 for use in association with four one-gallon jugs, article retaining flaps with a single slot as well as other multiple slots configurations are also contemplated for use with contoured articles of varying size and dimensions, or containers of varying size to house any desired number of articles.

Score line 55 spans the width of article retaining flap 52 (and article retaining flap 54 by incorporation), and allows for cooperation between article retaining flap 52 and corresponding side panel member 22. In particular, and as will be explained in more detail below, score line is positioned in article retaining flap 52 to compensate for the thickness of side panel member 22, as article retaining flap 52 must fold over the top edge of side panel member 22.

Furthermore, article retaining flap 52 preferably has a width 59 which is smaller than width 59' of corresponding side panel member 22. This smaller width, in turn, allows the article retaining flap member to be folded about its hinge through an entire range of foldable motion without experiencing interference from either adjacent top flaps 56 and 58, or from side panel members 26 and 28 which are positioned proximate to article retaining flap 52 upon erection of container apparatus 100.

Tab 60 foldably emanates from either left side edge of front side panel member 22, or right side edge of second side panel member 28. Tab 60 further consists of top edge 62 and bottom edge 64, which are both preferably cut at an angle to facilitate erection of container apparatus 100. Moreover, although the tab is shown as having height similar to that of side panel members 22, 24, 26, and 28, the tab may also take different sizes and configurations as may be required for specific applications.

Figure 5:
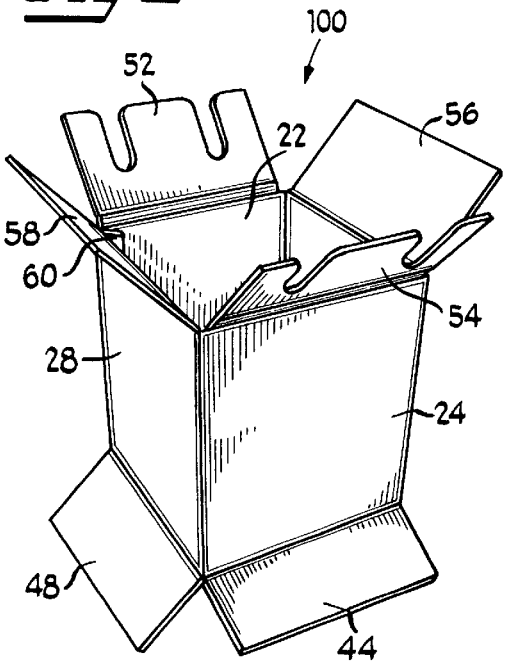
FIG. 5 of the drawings is a top perspective view of the container apparatus during articulation.
Figure 6:
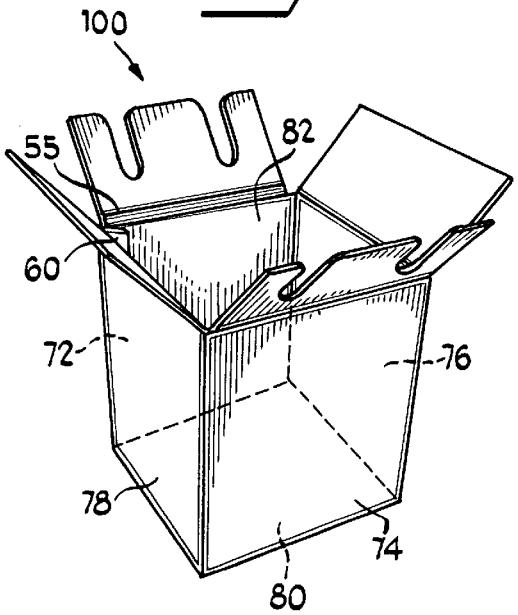
FIG. 6 of the drawings is a top perspective view of the container apparatus with an articulated base member.

To erect container apparatus 100, and as is shown in FIG. 5, side panel members 22, 24, 26, and 28 are folded about their side edges such that the adjacent side panel members are oriented substantially perpendicular to one another. In this position, the left side edge of side front side panel 22 meets the right side edge of second side panel member 28. Tab 60, foldably emanating from second side panel member 28, is attached by adhesive or other suitable fastening means to the inside face of front side panel member 22. As is depicted in FIG. 6, once the tab is secured, the container apparatus is partially erected with front sidewall 72 and back sidewall 74 positioned substantially parallel to one another, and first sidewall 76 and second sidewall 78 likewise positioned parallel to one another.

Figure 7:
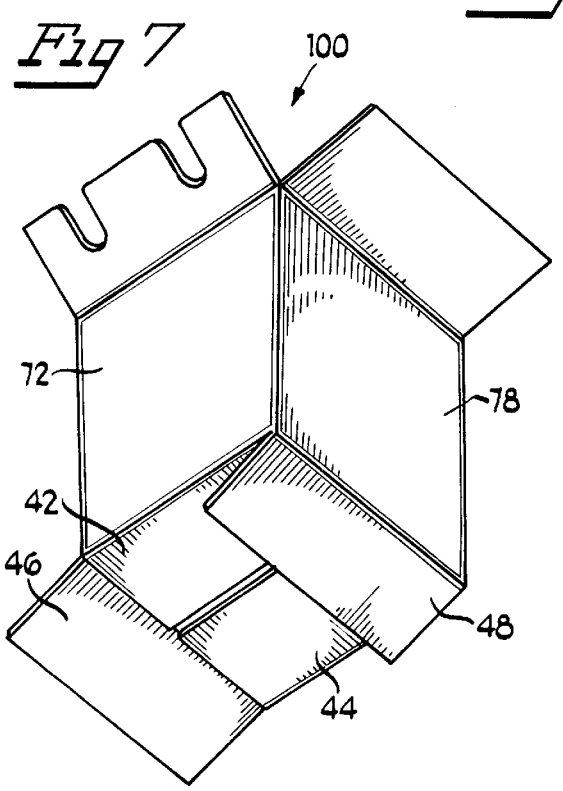
FIG. 7 of the drawings is a bottom perspective view of the container apparatus during articulation of the base member.
Figure 8:
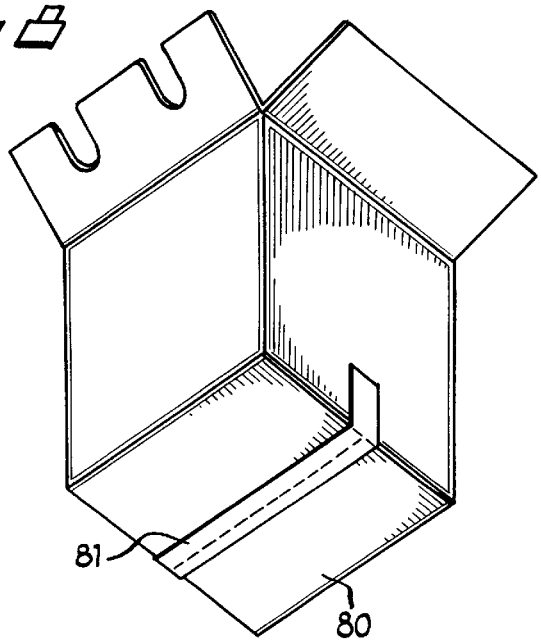
FIG. 8 of the drawings is a bottom perspective view of the container apparatus with the base member articulated.

Upon articulation of the side panel members, base member 80 is then formed. As can be seen in FIGS. 6–8, in forming base member 80, bottom flaps 42 and 44 are first folded toward the inside face of corresponding sidewalls 72 and 74, thus forming an interior region 82 in container apparatus 100. Preferably, bottom flaps 42 and 44, upon articulation, lie in the same approximate plane, a plane that is substantially perpendicular to the planes defined by corresponding sidewall members 72 and 74. Next, bottom flaps 46 and 48 are folded in a similar manner toward the inside faces of corresponding sidewalls 76 and 78. Bottom flaps 46 and 48 are likewise folded until they lie in the same approximate plane, a plane that is substantially perpendicular to sidewalls 76 and 78. Upon resting on top of bottom flaps 42 and 44, bottom flaps 46 and 48 are sealed in this position by tape 81 or other similar adhesive.

In this position, bottom flaps 46 and 48 lie in substantial abutment with bottom flaps 42 and 44, thus providing a base member that is reinforced with at least two layers of paperboard material. Moreover, when corrugated paperboard is used in constructing container apparatus 100, the direction of corrugation in bottom flaps 42 and 44 is oriented transverse to the direction of corrugation in overlapping bottom flaps 46 and 48. This transverse corrugation orientation provides increased multidirectional strength to both the base member, and the container apparatus as a whole.

Figure 9:
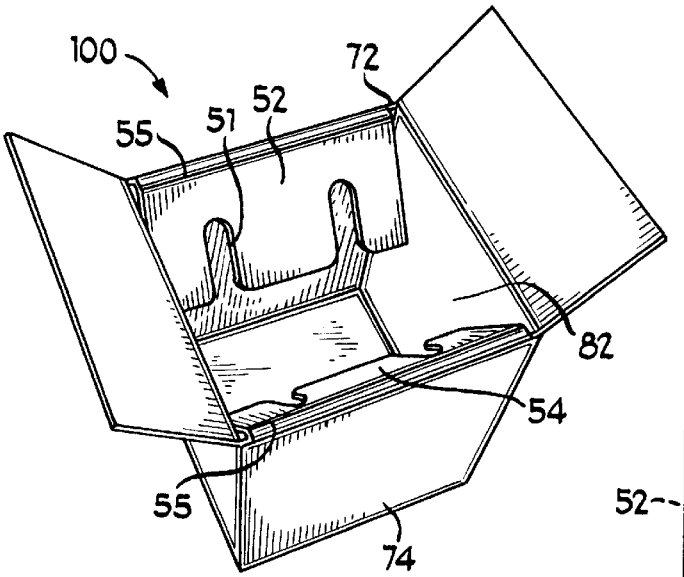
FIG. 9 of the drawings is a top perspective view of the container apparatus with article retaining flaps positioned to accept the contoured articles.
Figure 10:
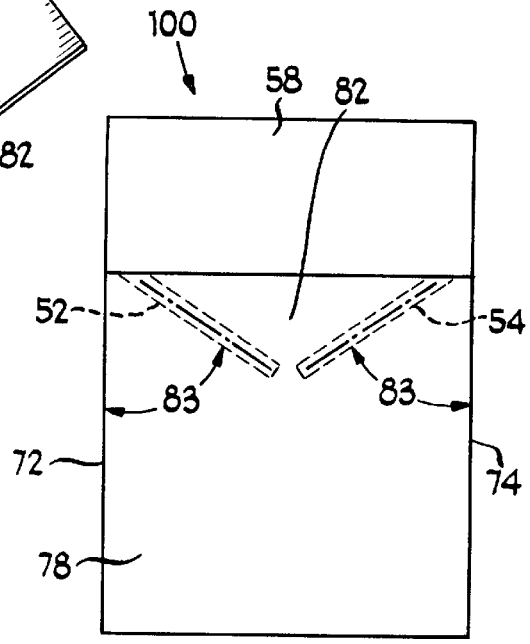
FIG. 10 of the drawings is a side elevational view of the container apparatus with the article retaining flaps positioned to accept the contoured articles.

Finally, and as is illustrated in FIGS. 9 and 10, once the base member is formed, article retaining flaps 52 and 54 are folded toward corresponding sidewall members 72 and 74, and toward interior region 82 of container apparatus 100. As can be seen, article retaining flaps 52 and 54 are preferably folded to a position where they are positioned at least partially within inner region 82 of the container apparatus. In this position, article retaining flaps 52 and 54 form an acute angle 83 with corresponding sidewalls 72 and 74. To this end, score lines 55 facilitate the folding of article retaining flaps 52 and 54 over the top edges of corresponding sidewalls 72 and 74, and into a position where acute angle 83 is formed. This positioning of the article retaining flaps allow preparation of the flaps for cooperation with contoured articles 102, upon insertion of the contoured articles into the interior region of the container apparatus.

In operation, contoured articles 102 are placed into container apparatus 100. As discussed hereinabove, the contoured articles may take the form of the handled one gallon jugs shown in FIG. 2, but may also be any article with a contour in its shape (see, for instance, FIGS. 3 and 4).

Figure 11:
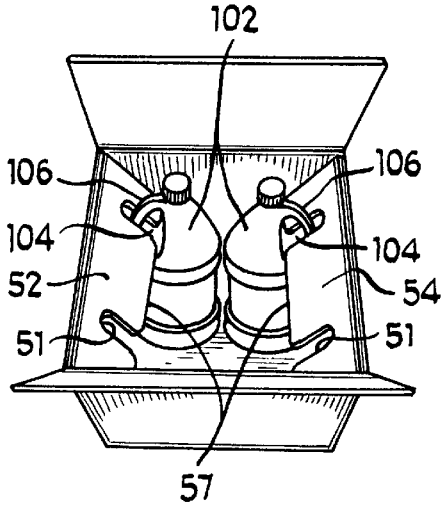
FIG. 11 of the drawings is a top perspective view of the container apparatus with the article retaining flaps retaining and stabilizing two contoured articles.

Specifically, and as shown in reference to FIG. 11, contoured article 102 is lowered into interior region 82 of container apparatus 100. Upon contact with article retaining flap 52, contoured article 102 forces the article retaining flap downward into interior region 82, and toward sidewall 72. Article retaining flap 52 approaches and may even come into contact with sidewall 72 while the contoured article is loaded into the container.

At this point, the fold-line memory capabilities inherent in article retaining flap 52—either alone or in combination with manual manipulation—prompt the flap to operatively move away from sidewall 72 and toward its original flap position. However, upon return of the article retaining flap to its original flap position, retention edge 57 with slot 51 locates contoured region 104 of article 102. Specifically, when this location occurs, handle 106 on contoured article 102 passes through slot 51 and retention edge 57 abuts contoured region 104. This abutment, in turn, stabilizes contoured article 102. Of course, after loading one contoured article, the other articles may be loaded and secured in a similar manner.

In the alternative, article retaining flaps 52 and 54 are positioned not within interior region 82 of container apparatus 100, but instead to allow contoured articles 102 to be loaded into the interior region without contacting article retaining flaps 52 and 54 (See FIG. 6 for position of article retaining flaps). Upon proper placement of article 102 in interior region 82, article retaining flap 52 is then moved downward into interior region 82 and toward sidewall 72. When article retaining flap 52 comes into contact with contoured article 102, retention edge 57 of article retaining flap 52 is directed into contact with contoured region 104. During this directing, article retaining flap 52 may be partially deformed from its original shape. To compensate for this deformation, article retaining flap 52 possesses inner flap memory capabilities such that the article retaining flap returns to and retains its original shape after being forced into contact with contoured region 104. This inner flap memory capability possessed by article retaining flap 52 allows retention edge to fully stabilize contoured article 102.

When secured in the retaining and stabilizing position, article retaining flap 52 prevents movement of contoured articles 102 rotationally, horizontally, and vertically. Specifically, as can be seen from FIGS. 11 and 14, slot 51 is configured so as to fit around handle 106 of contoured article 102, thus preventing any rotation of the contoured article about a longitudinal axis 105 running through the top and bottom of contoured article 12. Moreover, article retaining flap 52 also acts to prevent any movement of contoured article 102 in a vertical plane. In particular, retention edge 57 abuts contoured region 104 of contoured article 102 such that retaining member 52 holds contoured article 102 in abutment with base member 80, and prohibits any movement thereof. Finally, article retaining flap 52, in combination with the other contoured articles, prevents any movement of contoured article 102 in a horizontal plane. Specifically, contoured article is prohibited from sliding in any direction on the base member.

Figure 12:
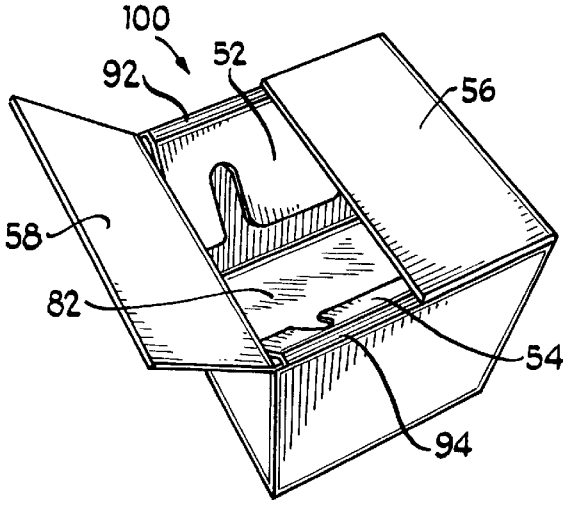
FIG. 12 of the drawings is a top perspective view of the container apparatus during articulation of the lid member.
Figure 13:
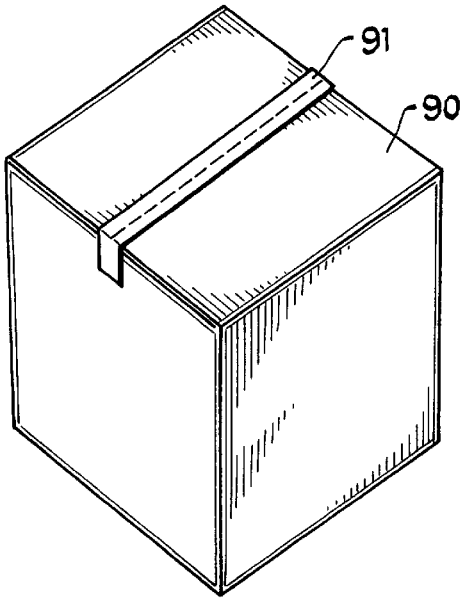
FIG. 13 of the drawings is a top perspective view of the container apparatus with the lid member fully articulated and prepared for handling.
Figure 14:
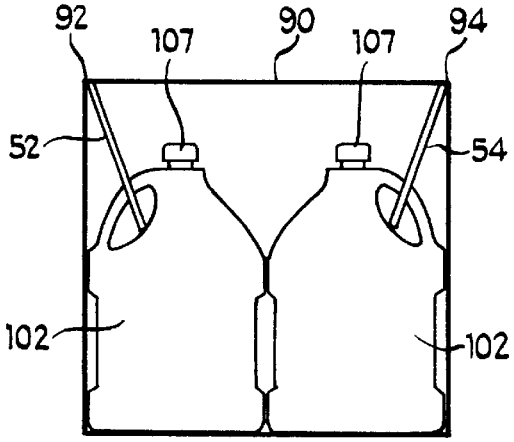
FIG. 14 of the drawings is a side elevational view of the interior region of the container apparatus retaining and stabilizing contoured articles after articulation of the lid member.

After contoured article 102 is retained and stabilized, and as is depicted in FIGS. 12–14, lid member 90 is formed. Specifically, top flaps 56 and 58 are folded downward toward interior region 82 of container apparatus 100. Upon coming into contact with folded over portions 92 and 94 of article retaining flap members 52 and 54, top flaps 56 and 58 are sealed in this position by securing means 91, such as tape, glue, or other adhesive. Preferably, lid member 90 occupies a horizontal plane that lies above tops 107 of contoured articles 102, such that there is an air gap between the tops of the contoured articles and the inner surface of lid member 90.

Upon sealing lid member 90, and in light of the multi-faceted and complete stabilization of contoured articles 102 inside of container apparatus 100, the container apparatus may be shipped, transported, stored, or even dropped without dislodging, causing movement from, or imparting damage to the contoured articles located therein. Moreover, because of this complete stabilization and this relationship of the contoured articles to lid member 90, tops 107 of the contoured articles never come into contact with the lid member. This feature is critical in certain applications, such as the transportation and handling of hazardous substances and the transportation and handling of fragile articles—in which either the nature of the article or legal regulations prohibit contact of the top of a contoured article with the lid of the container apparatus upon impact, stacking, dropping, or any other general movement of the container.

To remove a contoured article 102 from container apparatus 100, article retaining flap 52 is simply forced back toward the inside face of corresponding sidewall 72 such that retention edge 57 and thus article retaining flap 52 disengage from contoured region 104 of article 102. Upon disengagement, contoured article 102 may be removed from interior region 82 of container apparatus 100. Moreover, if another contoured article remains in container apparatus 100, the fold-line memory capability possessed by article retaining flap 52 simply forces the article retaining flap to restabilize any remaining contoured articles in the manner described hereinabove with reference to inserting and stabilizing a single contoured article.

Figure 15:
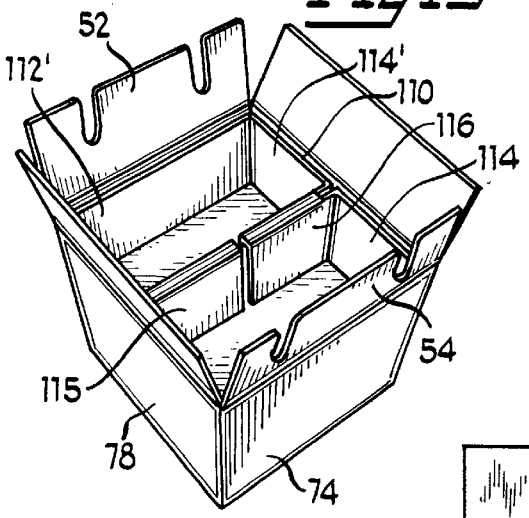
FIG. 15 of the drawings a top perspective view of the container apparatus with dividing members.
Figure 16:
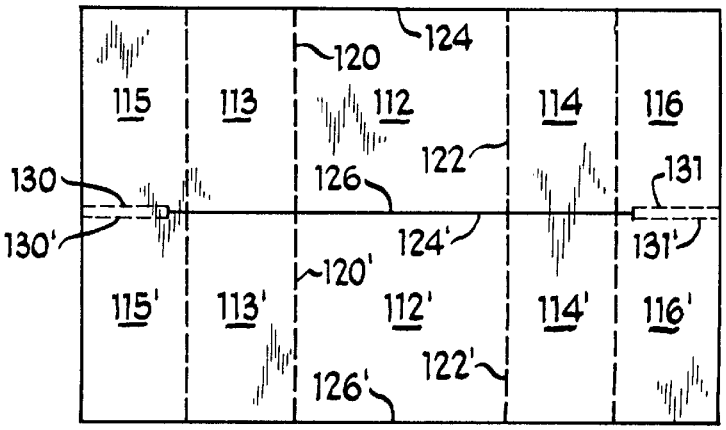
FIG. 16 of the drawings is a plan view of the blank for forming the dividing member for use with the container apparatus of the present invention.

In another embodiment, shown in FIG. 15, the container apparatus further includes dividing member 110. Although dividing member 110 is preferably constructed from the same material as the container apparatus—namely double-walled corrugated paperboard or any other paperboard, corrugated paperboard, plastic, metal, wood, ceramic, etc.—it is also contemplated that the dividing member is constructed from a different material for a desired application. Moreover, it is also preferred that the dividing member is constructed from a substantially unitary paperboard dividing blank 111, as shown in FIG. 16.

Substantially unitary paperboard dividing blank 111 comprises top center panel 112, top left wing panel 113, top right wing panel 114, top left end panel 115, top right end panel 116, bottom center panel 112', bottom left wing panel 113', bottom right wing panel 114', bottom left end panel 115', and bottom right end panel 116'. Top center panel 112 consists of left edge 120, right edge 122, top edge 124, and bottom edge 126. Top left wing panel 113 foldably emanates from left edge 120 of the top center panel, while top right wing panel 114 foldably emanates from right edge 122 of the top center panel. Likewise, top left end panel 115 foldably emanates from the left edge of top left wing panel 113 and top right end panel 116 foldably emanates from the right edge of top right wing panel 114.

Similarly, bottom center panel 112' consists of left edge 120', right edge 122', top edge 124', and bottom edge 126'. Bottom left wing panel 113' foldably emanates from left edge 120' of the bottom center panel, while bottom right wing panel 114' foldably emanates from right edge 122' of the bottom center panel. Likewise, bottom left end panel 115' foldably emanates from the left edge of bottom left wing panel 113' and bottom right end panel 116' foldably emanates from the right edge of bottom right wing panel 114'. Moreover, bottom left end panel 115' also foldably emanates from at least a portion of the bottom edge of top left end panel 115, and bottom right end panel 116' foldably emanates from at least a portion of the bottom edge of top right end panel 116.

Top left end panel 115 and top right end panel 116 further consist of score lines 130 and 131 positioned proximate the bottom edge each respective top end panel, while bottom left end panel 115' and bottom right end panel 116' further consist of score lines 130' and 131' positioned proximate the top edge of each respective bottom end panel. Specifically, score lines 130 and 130' extend from the left edges of top left end panel 115 and bottom left end panel 115', respectively, to an inward position between the left and right edges of the corresponding top and bottom left end panels. Similarly, score lines 131 and 131' extend from the right edges of top right end panel 116 and bottom right end panel 116', respectively, to an inward position between the right and left edges of the corresponding top and bottom right end panels. Moreover, the blank is cut and separable between these two sets of score lines. As is discussed below, these score lines allow for effective folding of top left end panel 115 over bottom left end panel 115', and folding of top right end panel 116 over bottom right end panel 116'.

To articulate blank 111, top left wing panel 113 and bottom left wing panel 113' are folded about their right side edges such that they are approximately perpendicular with top and bottom center panels 112 and 112', respectively. Likewise, top right wing panel 114 and bottom right wing panel 114' are folded about their left side edges such that they are approximately perpendicular with the top and bottom center panels 112 and 112', respectively.

Next, top left end panel 115 and bottom left end panel 115' are folded about their right side edges such they are approximately perpendicular to top left and bottom left wing panels 113 and 113', respectively, while top right end panel 116 and bottom right end panel 116' are folded about their left edges such that they are approximately perpendicular to top right and bottom right wing panels 114 and 114', respectively. In this position, the top left end panel, bottom left end panel, top right end panel, and bottom right end panel are substantially opposing and parallel to top center panel 112 and bottom center panel 112'.

Finally, top left end panel 115 and top left end panel 116 are then folded about score lines 130, 130', 131, and 131', respectively, over bottom left end panel 115' and bottom right end panel 116' into an articulated position. In this articulated position, top left end panel 115 is positioned in substantial abutment with bottom left end panel 115', and top right end panel 116 is positioned is substantial abutment with bottom right end panel 116'. Of course, the top right and bottom right end panels, like the top left and bottom left end panels, remain attached along the fold lines. In this configuration, the blank preferably takes the form of two substantially c-shaped rectangles.

As can be seen in reference to FIG. 15, upon insertion of dividing blank 111 into interior region 82 of the container apparatus, top center panel 112 is positioned in substantial abutment with the inside face of sidewall 72, while bottom center panel 112' is positioned in substantial abutment with the inside face of opposing sidewall 74. Meanwhile, top left wing panel 113 and bottom left wing panel 113' are positioned in substantial abutment with sidewall 78, while top right wing panel 114 and bottom right wing panel 114' are positioned in substantial abutment with opposing sidewall 76. Inasmuch as top left end panel 115 and bottom left end panel 115' are folded into substantial abutment with one another during blank articulation, and top right end panel 116 and bottom right end panel 116' are likewise folded into substantial abutment with one another during blank articulation, these end panel folded combinations extend between the pair of first and second opposing sidewalls 76 and 78, preferably bisecting interior region 82 of the container apparatus. Although these end panel folded combinations preferably come together at their free edges, it is likewise contemplated that a gap may exist therebetween. Moreover, although blank 111 securably fits into the container apparatus without any adhesive, the use an adhesive or similar means to enhance securement of the blank inside the container is also contemplated. Insertion of the blank divides the container apparatus into two substantially rectangular compartments, separated by the articulated end panels.

Furthermore, while dividing blank 111 is preferred, the dividing member need only consist of a single dividing panel, or multiple dividing panels, to be inserted between the pair of opposing first and second sidewalls 76 and 78. A single panel may be secured to the pair of opposing sidewalls, or in the alternative, to the inside face of the base member. Moreover, the dividing member may be of any preferred height, so long as the height does not exceed the height of the container sidewall members.

The use of a dividing member, in turn, allows removal of single contoured articles one at a time from the container apparatus, with increased stabilization for the articles remaining inside the interior region of the container. Specifically, a dividing member prevents the article retaining flap from pushing a retained contoured article into the vacant space created by the removal of a single contoured article.

The container apparatus that is the subject of the current disclosure is particularly well suited for the packaging, transportation and storage of hazardous materials, in substantial conformity with requirements of both the International Safe Transit Authority (ISTA) and the United Nations (UN) hazardous material shipping standards.

The foregoing description and drawings merely explain and illustrate the invention and the invention is not limited thereto except insofar as the appended claims are so limited, as those skilled in the art who have the present disclosure before them will be able to make modifications and variations therein without departing from the scope of the invention.

What is claimed is:

1. A container apparatus for releasably retaining and stabilizing contoured articles for transport, storage, and shipment, said container apparatus comprising:

a base member having at least four edges;

at least four upstanding sidewall members, each having a bottom edge, a top edge opposite the bottom edge, an outer surface and an inner surface, each of said at least four sidewall members associated with and foldably emanating from each of said base member edges, respectively, at a bottom edge of said sidewall member, said base member and said sidewall members, upon articulation, collectively defining an inner region for releasably retaining at least one article;

at least one article retaining member foldably emanating from the top edge of at least one of said associated sidewall members at an inner periphery, upon articulation of the container, and having an outer periphery, said at least one article retaining member being positionable toward and into said inner region so as to form an acute angle with said respective sidewall member from which it emanates, and said outer periphery of said at least one article retaining member further including an article retention edge positioned away from the top edge of said respective at least one sidewall member from which it emanates to a position substantially opposite said inner periphery, said retention edge shaped so as to approximate at least a portion of the contour of an article placed into said inner region, to, in turn, engage and stabilize said contoured article and to prevent undesired movement of the same.

2. The container apparatus according to claim 1 wherein prior to loading a contoured article into the inner region of the container, said at least one article retaining member is shaped and positioned to pivot towards the inner surface of said respective sidewall upon loading of a contoured article into said inner region, and articulate back to said acute angle upon completion of the loading of said article;

said retention edge, upon said completion of loading and articulation back to said acute angle, foldably returning to a position abutting a contoured portion of an article, to, in turn stabilize said article to prevent undesired movement of the same.

3. The container apparatus according to claim 1 further comprising a lid member for operably covering at least a portion of said inner region of the container apparatus.

4. The container apparatus according to claim 3 wherein said lid member comprises a top flap member foldably emanating from the top edge of at least one of said sidewall members, so that upon articulation, said lid member covers at least a portion of said inner region of the container apparatus.

5. The container apparatus according to claim 3 wherein said lid member consists of at least two top flap members, each of said top flap members foldably emanating from the top edge of opposing sidewall members.

6. The container apparatus according to claim 1 wherein said base member comprises a substantially unitary panel.

7. The container apparatus according to claim 1 wherein said base member comprises at least two bottom panel members, each of said bottom panel members foldably emanating from the bottom edge of opposing sidewall members.

8. The container apparatus according to claim 1 in which said apparatus includes two article retaining members, each of said article retaining members foldably emanating from the top edge of opposing sidewall members.

9. The container apparatus according to claim 1 wherein at least a portion of said contoured article prevents migration of said retention edge and, in turn, said article retaining member from said acute angle and, in turn, said position of said retention edge about said portion of said article contour.

10. The container apparatus according to claim 9 wherein said retention edge comprises at least one slot configuration so as to engage and stabilize contoured articles with a handle.

11. The container apparatus according to claim 9 wherein said retention edge consists of two slotted configurations to engage and stabilize two contoured articles with handles.

12. The container apparatus according to claim 1 wherein at least two opposing sidewall members include carrying means to facilitate movement and transportation of said container apparatus.

13. The container apparatus according to claim 12 wherein said carrying means comprises apertures cut out of said at least two opposing sidewalls.

14. The container apparatus according to claim 1 wherein said article retaining member, acting to stabilize a contoured article, prevents inadvertent migration of said retained contoured article in a vertical plane, to prevent migration of said articles away from the base member and toward the top of said container, and in a horizontal plane, isolating said retained contoured article from migrating toward any one of said sidewall members.

15. The container apparatus according to claim 1 wherein said article retaining member, acting to stabilize a contoured article, further prevents inadvertent movement of said contoured article in a rotational direction.

16. The container apparatus according to claim 1 wherein said at least one article retaining member, upon insertion of a contoured article into said container apparatus is directed into the inner region of said container apparatus and toward the associated sidewall member from which it emanates, said article retaining member possessing fold-line memory capabilities such that the article retaining member is, at least in part, prompted back toward its original position before engaging and stabilizing said contoured article.

17. The container apparatus according to claim 1 wherein said at least one article retaining member, upon insertion of a contoured article into the inner region of said container apparatus, may be directed over the top of a portion of said article into engagement with said contoured article at said acute angle, said article retaining member possessing inner flap memory capabilities such that the article retaining member substantially returns to its original shape after being positioned to stabilize the contoured region of said contoured article.

18. A container apparatus for releasably retaining and stabilizing contoured articles for transport, storage, and shipment, said container apparatus comprising:

a base member having at least four edges;

at least four upstanding sidewall members each having a bottom edge, a top edge opposite the bottom edge, an outer surface and an inner surface, each of said at least four sidewall members associated with and foldably emanating from each of said base member edges at a bottom edge of said sidewall member, said base member and said sidewall members, upon articulation, collectively defining an inner region for releasably retaining at least one article;

at least one article retaining member foldably emanating from the top edge of at least one of said associated sidewall members, upon articulation of the container, said at least one article retaining member being positionable toward and into said inner region so as to form an acute angle with said respective sidewall member from which it emanates, said at least one article retaining member further having an article retention edge positioned away from the top edge of said respective at least one sidewall member from which it emanates to engage and stabilize said contoured article and to prevent undesired movement of the same;

the container apparatus being constructed from a substantially unitary paperboard blank, said substantially unitary paperboard blank comprising front, back, first, and second side panel members each having four edges, including a top edge, bottom edge, and two side edges, said front side panel member foldably emanating from the left edge of said first side panel member, said first side panel member foldably emanating from the left edge of said back side panel member, said backside panel member foldably emanating from the left edge of said second side panel member;

said side panel members, upon articulation, forming front, back, first, and second upstanding sidewall members of said container apparatus;

a bottom flap foldably emanating from the bottom edge of at least one of said side panel members, said at least one bottom flap, upon articulation, forming a base member of said container apparatus;

an article retaining flap foldably emanating from the top edge of at least one side panel member and having an article retention edge positioned away from the top edge of said associated at least one side panel member from which it emanates to contact and stabilize a contoured article, said article retaining flap, upon articulation, forming the article retaining member of said container apparatus, and being positionable toward and into said inner region;

a plurality of top flaps, each top flap foldably emanating from the respective top edge of said opposing side panel members, said top flaps, upon articulation, forming the lid member of said container apparatus.

19. The container apparatus according to claim 18 wherein the at least one article retaining flap consists of scored fold line positioned near said foldable emanation from said at least one sidewall member so as to effectively cooperate with said sidewall member.

20. The substantially unitary paperboard blank according to claim 18 wherein said unitary paperboard blank further consists of an article retaining flap foldably emanating from two opposing side panel members.

21. The substantially unitary paperboard blank according to claim 18 wherein a bottom flap member foldably emanates from the bottom edge of each of said front, back, first, and second side panel members such that upon articulation, said bottom flaps are capable of forming the base member of said container apparatus by a locking orientation of said bottom flaps.

22. The substantially unitary paperboard blank according to claim 21 wherein said bottom flaps each comprise at least one layer of corrugated paperboard material, with each layer having a direction of corrugation, and upon articulation to form said base member, at least a portion of said bottom panel members lie in an overlapping relationship such that said corrugation direction of one of said bottom panel members is positioned in a transverse relationship to the corrugation direction of at least one other of said bottom panel members so as to impart overall increased multidirectional strength to said base member and said container apparatus.

23. The substantially unitary paperboard blank according to claim 18 wherein said at least one article retaining flap consists of at least one layer of corrugated paperboard having a direction of corrugation, the direction of corrugation running transverse to said article retention edge.

24. The substantially unitary paperboard blank according to claim 18 wherein a tab foldably emanates from either of said front or said second side panel members such that during articulation of said container apparatus, said tab provides increased joinder between said front and said second side panel members, and imparts overall increased integrity to said container apparatus.

25. The substantially unitary paperboard blank according to claim 18 wherein said unitary paperboard blank is constructed at least in part from corrugated paperboard.

26. The substantially unitary paperboard blank according to claim 18 wherein at least a portion of said substantially unitary paperboard blank is coated with a moisture impervious material.

27. The substantially unitary paperboard blank accordingly to claim 18 wherein at least one set of opposing side panel members further consists of a carrying means comprising apertures to facilitate the movement and transportation of said container apparatus.

28. A container apparatus for releasably retaining and stabilizing contoured articles for transport, storage, and shipment, said container apparatus comprising:

a base member having at least four edges;

at least four upstanding sidewall members, each having a bottom edge, a top edge opposite the bottom edge, an outer surface and an inner surface, each of said at least four sidewall members associated with and foldably emanating from each of said base member edges at a bottom edge of said sidewall member, said base member and said sidewall members, upon articulation, collectively defining an inner region for releasably retaining at least one article;

at least one article retaining member foldably emanating from the top edge of at least one of said associated sidewall members, upon articulation of the container, said at least one article retaining member being positionable toward and into said inner region so as to form an acute angle with said respective sidewall member from which it emanates, said at least one article retaining member further having an article retention edge positioned away from the top edge of said respective at least one sidewall member from which it emanates to engage and stabilize said contoured article and to prevent undesired movement of the same; and at least one dividing member for separation of said inner region of the container apparatus into compartments for said contoured articles, to, in turn, further stabilize said contoured articles.

29. The container apparatus according to claim 28 wherein the dividing member comprises a least one dividing panel operably positioned between said ones of said opposing sidewall members unattached to an article retaining member.

30. The divider member according to claim 29 wherein said at least one dividing panel is of a height not exceeding the height of the top edges of said opposing sidewall members.

31. The divider member according to claim 28 wherein said divider member is constructed from a substantially unitary paperboard blank, said substantially unitary paperboard blank comprising:

a top center panel having a pair of opposed top and bottom edges, and a pair of opposed first and second side edges;

top left and top right wing panels foldably emanating from the respective opposed first and second side edge portions of said top center panel member, said top left and top right wing panels each having opposed top and bottom edges, and opposed first and second side edges;

a top left end panel foldably emanating from the left edge of said top left wing panel;

a top right end panel foldably emanating from the right edge of said top right wing panel;

a bottom center panel having a pair of opposed top and bottom edges, and a pair of opposed first and second side edges;

bottom left and bottom right wing panels foldably emanating from the respective opposed first and second side edge portions of said bottom center panel member, said bottom left and bottom right wing panels each having opposed top and bottom edges, and opposed first and second side edges;

a bottom left end panel foldably emanating from the left edge of said bottom left wing panel, and from the bottom edge of said top left end panel; and a bottom right end panel foldably emanating from the right edge of said bottom right wing panel, and from the bottom edge of said top right end panel, said divider member articulating into two substantially c-shaped rectangles to divide said inner region of the container apparatus into two substantially rectangular compartments.

32. The divider member according to claim 31 wherein said top right end panel and said top left end panel each include a scored fold line operably positioned proximate the bottom edge of each of said respective end panels, said bottom right end panel and said bottom left end panel each including a scored fold line positioned proximate the top edge of each of said respective end panels, said end panel score lines facilitating the folding of said top right end panel over said bottom right end panel and the top left end panel over said bottom left end panel, respectively.

33. The divider member according to claim 32 wherein said score lines between said top left and bottom left end panels extend from the left edge of said top and bottom left end panels to an inward position between the left and right edges of said top and bottom left end panels, said score lines between said top and bottom right end panels extend from the right edge of said top and bottom right end panels to an inward position between the right and left edges of said top and bottom right end panels, said blank being cut and separable between said two sets of score lines.

34. The divider member according to claim 31 wherein said divider member is constructed from at least one layer of corrugated paperboard.

35. A method for releasably retaining and stabilizing contoured articles for transport, storage, and shipment in a container apparatus, said method comprising the steps of:

providing a base member with at least four edges; an upstanding sidewall member associated with and foldably emanating from each of said base member edges, respectively, said base member and said upstanding sidewall members collectively defining an inner region; and at least one article retaining member foldably emanating from the top edge of at least one of said sidewall members at an inner periphery and having an outer periphery, said outer periphery of said article retaining member including an article retention edge positioned away from the top edge of said upstanding sidewall member from which it emanates to a position substantially opposite said inner periphery, said retention edge shaped so as to approximate at least a portion of the contour of an article placed into said inner region;

positioning said at least one article retaining member such that a contoured article to be housed inside said container apparatus comes into contact with said article retaining member upon placement of the article into the inner region of said container;

inserting said contoured article into the inner region of said container apparatus such that upon entry, said contoured article forces down the article retaining member, towards directing the article retaining member to pivot downwardly about its hinged association with said container sidewall toward the inside face of said sidewall;

articulating, upon complete insertion of said contoured article into said inner region of said container apparatus, said article retaining flap member away from said inner face of said sidewall, toward an acute angle at which it engages said contoured article; and positioning, upon complete pivoting of the article retaining member, the retention edge of said retaining member into mating engagement with said contoured article such that the article retaining member stabilizes said article and prevents undesired movement of the same.

36. A container apparatus for releasably retaining and stabilizing contoured articles for transport, storage, and shipment, said container apparatus comprising:

a base member having at least four edges;

at least four upstanding sidewall members, each having a bottom edge, a top edge opposite the bottom edge, an outer surface and an inner surface, each of said at least four sidewall members associated with and foldably emanating from each of said base member edges at a bottom edge of said sidewall member, said base member and said sidewall members, upon articulation, collectively defining an inner region for releasably retaining at least one article;

at least one article retaining member foldably emanating from the top edge of at least one of said associated sidewall members, upon articulation of the container, said at least one article retaining member being positionable toward and into said inner region so as to form an acute angle with said respective sidewall member from which it emanates, said at least one article retaining member further having an article retention edge positioned away from the top edge of said respective at least one sidewall member from which it emanates to engage and stabilize said contoured article and to prevent undesired movement of the same; and a lid member for operably covering at least a portion of said inner region of the container apparatus, said lid member consisting of at least two top flap members, each of said top flap members foldably emanating from the top edge of opposing sidewall members.

37. A container apparatus for releasably retaining and stabilizing contoured articles for transport, storage, and shipment, said container apparatus comprising:

a base member having at least four edges;

at least four upstanding sidewall members, each having a bottom edge, a top edge opposite the bottom edge, an outer surface and an inner surface, each of said at least four sidewall members associated with and foldably emanating from each of said base member edges at a bottom edge of said sidewall member, said base member and said sidewall members, upon articulation, collectively defining an inner region for releasably retaining at least one article;

at least one article retaining member foldably emanating from the top edge of at least one of said associated sidewall members, upon articulation of the container, said at least one article retaining member being positionable toward and into said inner region so as to form an acute angle with said respective sidewall member from which it emanates, said at least one article retaining member further having an article retention edge positioned away from the top edge of said respective at least one sidewall member from which it emanates to engage and stabilize said contoured article and to prevent undesired movement of the same;

said base member comprising at least two bottom panel members, each of said bottom panel members foldably emanating from the bottom edge of opposing sidewall members.

38. A container apparatus for releasably retaining and stabilizing contoured articles for transport, storage, and shipment, said container apparatus comprising:

a base member having at least four edges;

at least four upstanding sidewall members, each having a bottom edge, a top edge opposite the bottom edge, an outer surface and an inner surface, each said at least four sidewall members associated with and foldably emanating from each of said base member edges at a bottom edge of said sidewall member, said base member and said sidewall members, upon articulation, collectively defining an inner region for releasably retaining at least one article;

at least one article retaining member foldably emanating from the top edge of at least one of said associated sidewall members, upon articulation of the container, said at least one article retaining member being positionable toward and into said inner region so as to form an acute angle with said respective sidewall member from which it emanates, said at least one article retaining member further having an article retention edge positioned away from the top edge of said respective at least one sidewall member from which it emanates, to engage and stabilize said contoured articles and to prevent undesired movement of the same, said retention edge of said at least one article retaining member being shaped so as to approximate the contour of an article placed therein, to, in turn, engage said contoured article for stabilization and prevention of undesired movement of the same, at least a portion of said contoured articles preventing migration of said retention edge and, in turn, said article retaining member from said acute angle, said retention edge having two slotted configurations to engage and stabilize two contoured articles with handles.

39. The container apparatus according to claim 1 further including at least one dividing member for separation of said inner region of the container apparatus into compartments for said contoured articles to, in turn, further stabilize said contoured articles.

* * * * *